US006247529B1

(12) United States Patent
Shimizu et al.

(10) Patent No.: US 6,247,529 B1
(45) Date of Patent: Jun. 19, 2001

(54) REFRIGERANT TUBE FOR A HEAT EXCHANGER

(75) Inventors: Fumio Shimizu; Hiroyasu Shimanuki; Hirohiko Watanabe; Yuichi Furukawa; Yuji Yamamoto, all of Oyama (JP); Arif Mujib Khan, Farmington Hills, MI (US); Qun Liu, Gross Ile, MI (US); Thaddeus Waskiewicz, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/338,851

(22) Filed: Jun. 25, 1999

(51) Int. Cl.[7] ..... F28F 1/00; F28F 1/14
(52) U.S. Cl. ..... 165/183; 165/177
(58) Field of Search ..... 165/177, 179, 165/181, 183

(56) References Cited

U.S. PATENT DOCUMENTS

| | | | | |
|---|---|---|---|---|
| 5,323,851 | * | 6/1994 | Abraham | 165/183 |
| 5,553,377 | | 9/1996 | Hirano et al. . | |
| 5,638,897 | | 6/1997 | Hirano et al. . | |
| 5,689,881 | * | 11/1997 | Kato | 165/177 |
| 5,730,215 | | 3/1998 | Hirano et al. . | |
| 5,749,144 | | 5/1998 | Hirano et al. . | |
| 5,784,776 | | 7/1998 | Saito et al. . | |
| 5,799,727 | * | 9/1998 | Liu | 165/177 |
| 5,931,226 | * | 8/1999 | Hirano et al. | 165/183 |

FOREIGN PATENT DOCUMENTS

0617250A2 * 3/1993 (JP) .

* cited by examiner

*Primary Examiner*—Marvin M. Lateef
*Assistant Examiner*—Tho Van Duong
(74) *Attorney, Agent, or Firm*—Larry I. Shelton

(57) ABSTRACT

A refrigerant tube for a heat exchanger, comprising: a generally flat tube 10 having generally flat upper and lower walls 12/14; a plurality of reinforcing walls 16 connected between the upper and lower walls 12/14, the reinforcing walls extending along and generally parallel with a longitudinal axis A—A of the tube and being spaced apart from one another by a predetermined distance; and a plurality of communication holes 18 distributed along the length of each reinforcing wall 16, thereby defining a plurality of discrete wall portions 20 along each reinforcing wall 16, each of the discrete wall portions 20 being disposed between adjacent communication holes 18 and having an upstream edge 22 and a downstream edge 24 thereof, the communication holes 18 and discrete wall portions 20 having lengths $L_1$ and $L_2$, respectively, as measured along the longitudinal axis A—A, the communication holes 18 being spaced apart along each reinforcing wall 16 by a pitch P. Each communication hole 18 in each reinforcing wall is disposed between the upstream and downstream edges 22/24 of a laterally adjacent discrete wall portion 20 of each adjacent reinforcing wall, such that a wall overlap ratio Wr, defined as $[P-2L_1]/P$, is greater than 0, and preferably $0.4 \leqq Wr \leqq 0.6$.

7 Claims, 4 Drawing Sheets

REFRIGERANT TUBE FOR A HEAT EXCHANGER

BACKGROUND OF THE INVENTION

1. Field of the Invention

The present invention relates generally to heat exchangers, and more specifically to refrigerant tubes for a heat exchanger.

2. Disclosure Information

FIGS. 1–2 illustrate the typical construction of most heat exchanger refrigerant tubes according to the prior art. As typified in FIG. 2, this construction includes a flat metallic tube 10 having flat upper and lower walls 12/14 with a plurality of reinforcing walls 16 connected between the upper and lower walls. These reinforcing walls 16 extend parallel to each other along the length of the tube 10, thereby forming a plurality of parallel flow channels 17 each bounded by the upper and lower walls 12/14 and two reinforcing walls 16. This tube construction can be made using a variety of approaches, such as those disclosed in U.S. Pat. No. 5,638,897 to Hirano et al., U.S. Pat. No. 5,784,776 to Saito et al., and U.S. Pat. No. 5,799,727 to Liu (each of which being incorporated herein by reference).

Such refrigerant tubes can be generally grouped into two categories: discrete flow and non-discrete flow. Discrete flow refrigerant tubes have parallel flow channels 17 which do not communicate with one another along the length of the tube; as illustrated in FIG. 3A, the reinforcing walls 16 of discrete flow tubes completely segregate each flow channel 17 from its neighboring flow channels. Non-discrete flow tubes, on the other hand, provide a plurality of apertures or openings 18 in the reinforcing walls 16, as illustrated in FIG. 3B; these openings 18 permit fluid communication among adjacent flow channels 17. Non-discrete flow tubes are more difficult to manufacture, but have the advantage of providing better heat transfer because of the cross-flow of refrigerant fluid among the flow channels through the openings 18.

Although it is known to provide such openings 18 to facilitate fluid cross-flow, no guidance has heretofore been provided for designing the size and spacing of these openings so as to optimize the heat transfer potential of non-discrete flow refrigerant tubes.

SUMMARY OF THE INVENTION

The present invention overcomes the shortcomings of the prior art approaches by providing a non-discrete flow refrigerant tube for a heat exchanger wherein the cross-flow among adjacent flow channels provides optimized heat transfer characteristics. The refrigerant tube comprises: a generally flat tube having generally flat upper and lower walls; a plurality of reinforcing walls connected between the upper and lower walls, the reinforcing walls extending along and generally parallel with a longitudinal axis of the tube and being spaced apart from one another by a predetermined distance; and a plurality of communication holes distributed along the length of each reinforcing wall, thereby defining a plurality of discrete wall portions along each reinforcing wall, each of the discrete wall portions being disposed between adjacent communication holes and having an upstream edge and a downstream edge thereof, the communication holes and discrete wall portions having lengths $L_1$ and $L_2$, respectively, as measured along the longitudinal axis, the communication holes being spaced apart along each reinforcing wall by a pitch P. Each communication hole in each reinforcing wall is disposed between the upstream and downstream edges of a laterally adjacent discrete wall portion of each adjacent reinforcing wall, such that a wall overlap ratio Wr, defined as $[P-2L_1]/P$, is greater than 0, and preferably $0.4 \leqq Wr \leqq 0.6$.

It is an object and advantage that the present invention provides an optimized range for the relative size and spacing of communication holes and discrete wall portions of non-discrete flow refrigerant tubes, such that the overall heat transfer coefficient of such tubes is optimized.

Another advantage is that the present invention may be easily integrated into the manufacturing process for known refrigerant tubes.

Yet another advantage is that the optimized design of the present invention may be used equally well with either one-piece or two-piece refrigerant tube constructions.

These and other advantages, features and objects of the invention will become apparent from the drawings, detailed description and claims which follow.

DETAILED DESCRIPTION OF THE PREFERRED EMBODIMENTS

Figure 1:
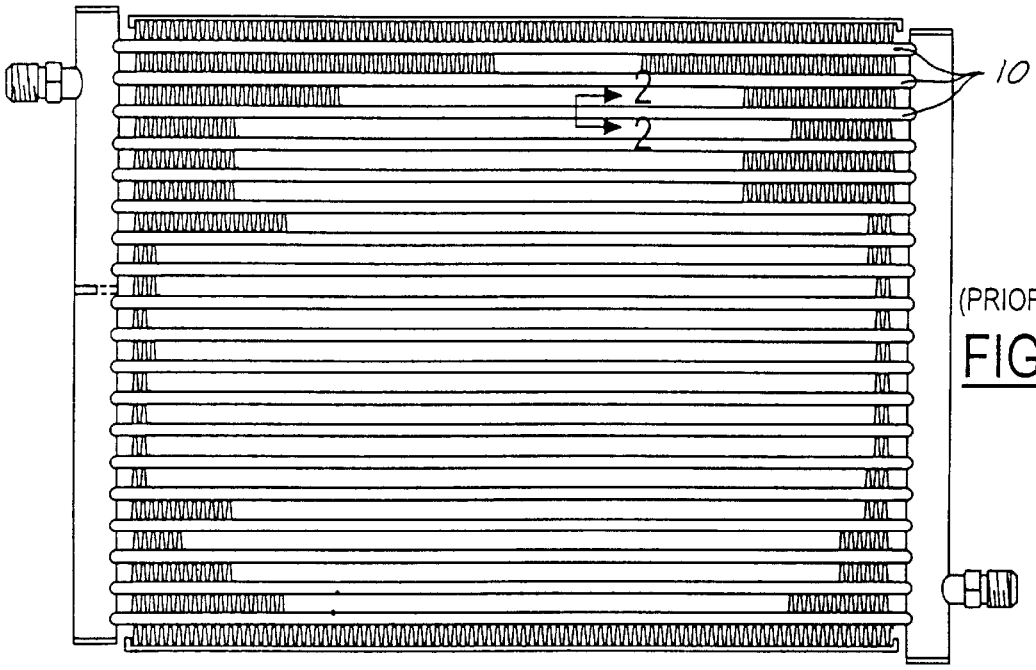
(PRIOR ART) FIG. 1
FIG. 1 is a front view of a heat exchanger with refrigerant tubes according to the prior art.
Figure 2:
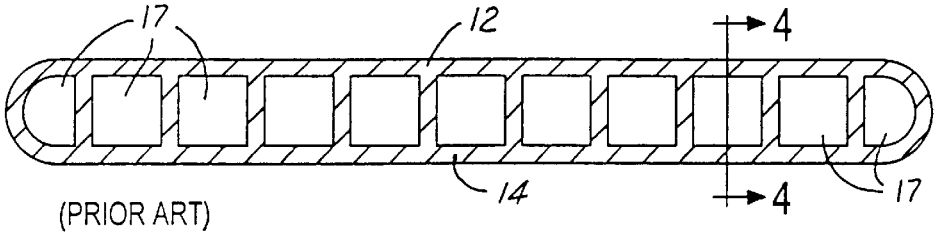
(PRIOR ART) FIG. 2
FIG. 2 is a section view of a refrigerant tube taken along line 2—2 in FIG. 1.
Figure 3A:
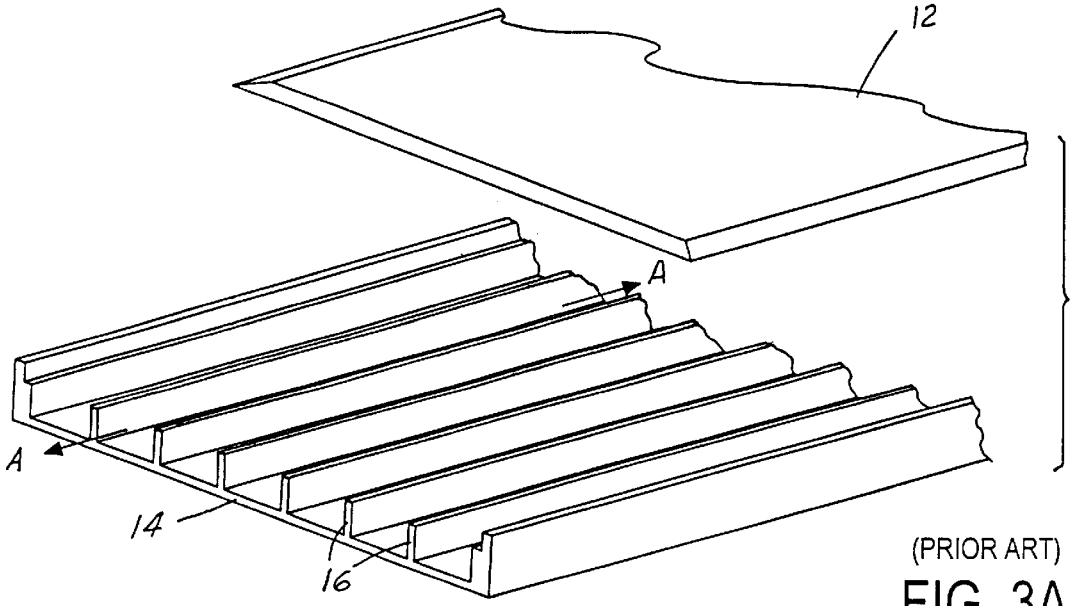
(PRIOR ART) FIG. 3A
FIGS. 3A–B are perspective views of discrete flow and non-discrete flow reinforcing walls, respectively, according to the prior art.
Figure 3B:
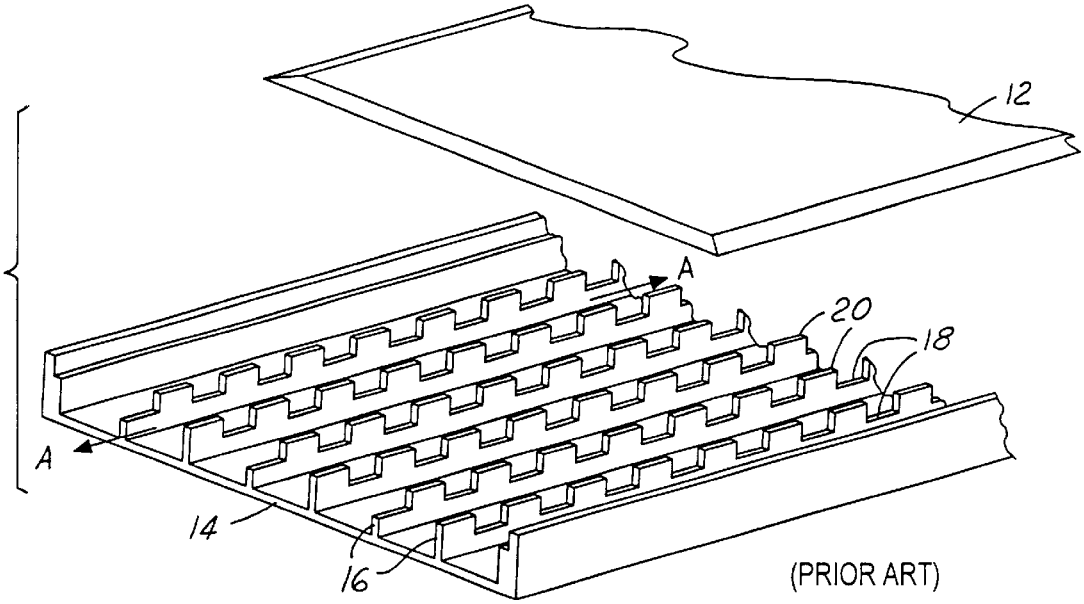
(PRIOR ART) FIG. 3B
Figure 4A:
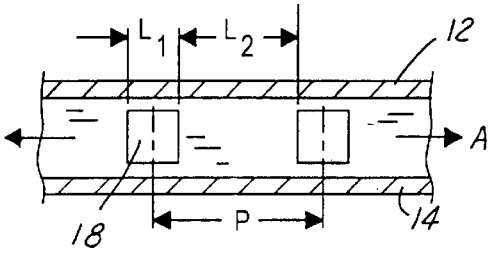
FIGS. 4A–C (collectively referred to as FIG. 4) are section views of the present invention taken along line 4—4 in FIG. 2.
Figure 5:
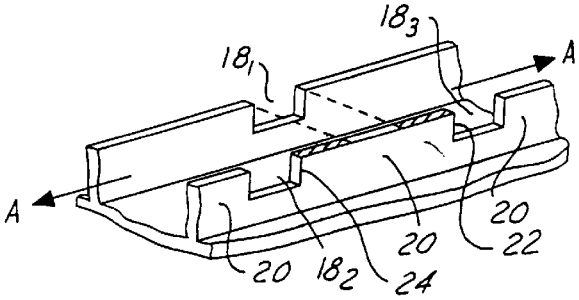
FIGS. 5–6 are perspective and top views, respectively, of selected reinforcing walls in a refrigerant tube according to the present invention.
Figure 4B:
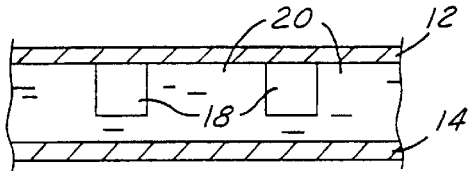
Figure 4C:
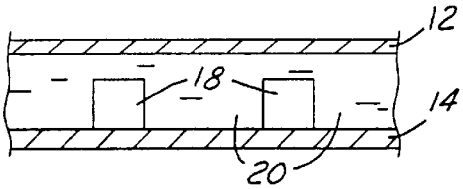
Figure 6:
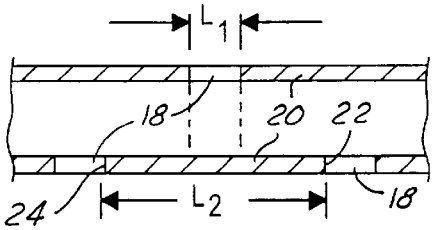
Figure 7A:
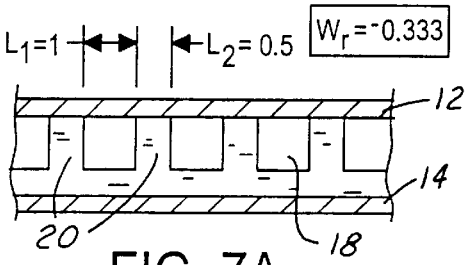
FIGS. 7A–D (collectively referred to as FIG. 7) are side views of reinforcing wall segments having various wall overlap ratios according to the present invention.
Figure 7B:
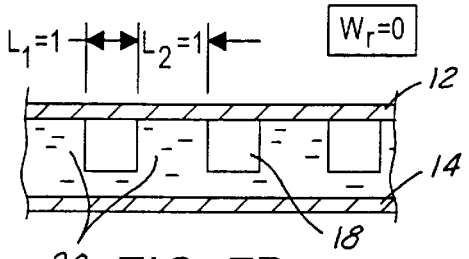
Figure 7C:
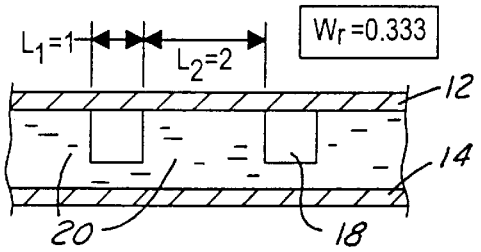
Figure 7D:
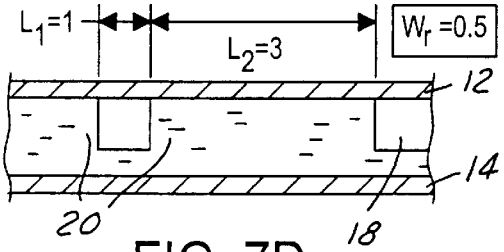
Figure 8A:
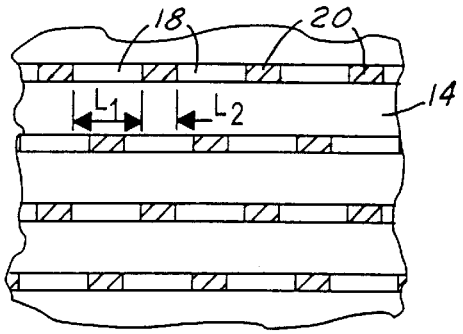
FIGS. 8A–D (collectively referred to as FIG. 8) are top section views of the wall segments shown in FIGS. 7A–D, respectively.
Figure 8B:
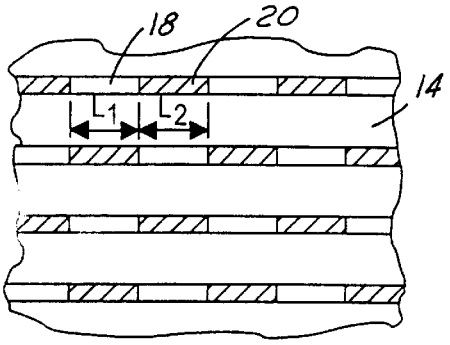
Figure 8C:
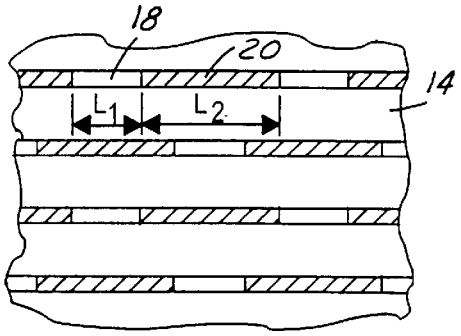
Figure 8D:
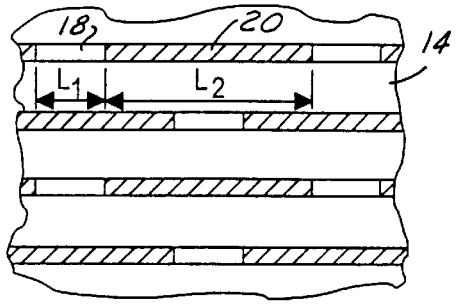

Referring now to the drawings, FIGS. 4–6 show a refrigerant tube for a heat exchanger according to the present invention. The invention comprises: a generally flat (typically metallic) tube 10 having generally flat upper and lower walls 12/14; a plurality of reinforcing walls 16 connected between the upper and lower walls 12/14, the reinforcing walls extending along and generally parallel with a longitudinal axis A—A of the tube and being spaced apart from one another by a predetermined distance; and a plurality of communication holes 18 distributed along the length of each reinforcing wall 16, thereby defining a plurality of discrete wall portions 20 along each reinforcing wall 16, each of the discrete wall portions 20 being disposed between adjacent communication holes 18 and having an upstream edge 22 and a downstream edge 24 thereof, the communication holes 18 and discrete wall portions 20 having lengths $L_1$ and $L_2$ respectively, as measured along the longitudinal axis A—A, the communication holes 18 being spaced apart along each reinforcing wall 16 by a pitch P. Each communication hole 18 in each reinforcing wall is disposed between the upstream and downstream edges 22/24 of a laterally adjacent discrete wall portion 20 of each adjacent reinforcing wall, such that a wall overlap ratio Wr, defined as $[P-2L_1]/P$, is greater than 0.

In order to assist the reader in understanding the present invention, the following list is provided showing all reference numerals used herein and the elements they represent:

| | |
|---|---|
| 10 = | Flat tube |
| 12 = | Upper wall |
| 14 = | Lower wall |
| 16 = | Reinforcing wall |
| 17 = | Flow channel |
| 18 = | Communication hole |
| 20 = | Discrete wall portion |
| 22 = | Upstream edge of discrete wall portion |
| 24 = | Downstream edge of discrete wall portion |
| A—A = | Longitudinal axis of tube |
| $L_1$ = | Length of communication hole |
| $L_2$ = | Length of discrete wall portion |
| P = | Pitch between adjacent holes = $L_1 + L_2$ |
| Wr = | Wall overlap ratio = $[P - 2L_1]/P$ |

As mentioned above, although it is known to provide communication holes 18 in the reinforcing walls 16 of refrigerant tubes to provide non-discrete flow (i.e., cross-flow) among adjacent flow channels 17, no teaching has been provided heretofore for optimizing the relative size and spacing of the holes 18 with respect to the discrete wall portions 20, so as to optimize the heat transfer coefficient h (measured in $kW/m^2K$) of the tube. The present invention fills this void by suggesting a design scheme for accomplishing such optimization.

According to the present invention, two criteria should be met to provide such heat transfer optimization: (1) the wall overlap ratio Wr should be greater than zero, and preferably greater than 0 and less than or equal to 0.9; and (2) each communication hole 18 should be disposed so as to lie generally centered between the upstream and downstream edges 22/24 of those discrete wall portions 20 that are on adjacent reinforcing walls 16—that is, laterally adjacent communication holes 18 should not overlap one another. (Note that, as used herein, "laterally adjacent" should be distinguished from "longitudinally adjacent"; as illustrated in FIG. 5, holes $\mathbf{18}_2$ and $\mathbf{18}_3$ lie within the same reinforcing wall 16 and are adjacent to each other along the longitudinal direction A—A, whereas hole $\mathbf{18}_1$ is laterally adjacent to both $\mathbf{18}_2$ and $\mathbf{18}_3$ in that hole $\mathbf{18}_1$ lies within a reinforcing wall that is laterally adjacent to the wall in which holes $\mathbf{18}_2$ and $\mathbf{18}_3$ lie.) Both of the foregoing criteria should be met in order to optimize the tube's heat transfer characteristics.

Figure 9:
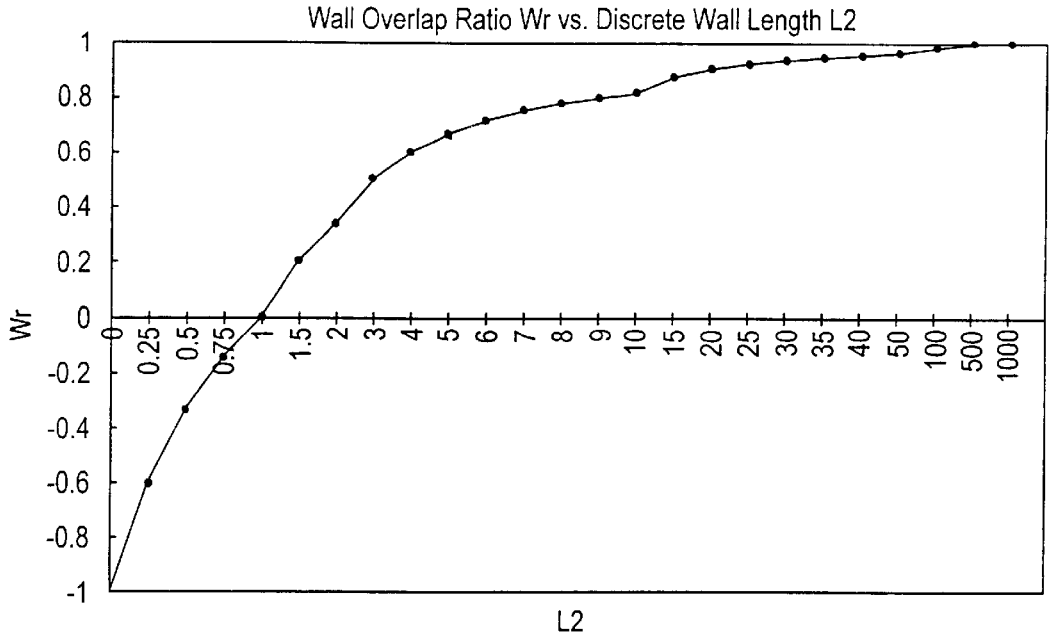
FIGS. 9–10 are plots of wall overlap ratio Wr versus discrete wall length $L_2$, and heat transfer coefficient h versus Wr, for a representative refrigerant tube according to the present invention.

If the length $L_1$ of the communication hole opening 18 is taken as 1 unit length, the following wall overlap ratios Wr are provided for various lengths $L_2$ of the discrete wall portion 18, as illustrated in FIGS. 7–8 and plotted in FIG. 9:

| Hole Length $L_1$ | Wall Length $L_2$ | Pitch P $(L_1 + L_2)$ | Wall Overlap Ratio Wr $[P - 2L_1]/P$ | FIGS. |
|---|---|---|---|---|
| 1 | 0.5 | 1.5 | −0.333 | 7A, 8A |
| 1 | 1 | 2 | 0 | 7B, 8B |
| 1 | 2 | 3 | 0.333 | 7C, 8C |

-continued

| Hole Length $L_1$ | Wall Length $L_2$ | Pitch P $(L_1 + L_2)$ | Wall Overlap Ratio Wr $[P - 2L_1]/P$ | FIGS. |
|---|---|---|---|---|
| 1 | 3 | 4 | 0.5 | 7D, 8D |
| 1 | 4 | 5 | 0.6 | — |
| 1 | 5 | 6 | 0.667 | — |
| 1 | 10 | 11 | 0.818 | — |
| 1 | 100 | 101 | 0.980 | — |
| 1 | 1000 | 1001 | 0.998 | — |

As shown by the table above and by FIG. 9, the wall overlap ratio Wr ranges asymptotically from a minimum value of −1 (for the case of a discrete wall length $L_2$ of zero length—i.e., the reinforcing wall 16 doesn't exist at all) to a maximum value of +1 (for the case of an infinitely long discrete wall length $L_2$—i.e., essentially no communication holes 18 exist at all). Amid these extremes the ratio Wr crosses zero (Wr=0) where the communication hole length $L_1$ and the discrete wall length $L_2$ are equal to each other ($L_1$=$L_2$)

Figure 10:
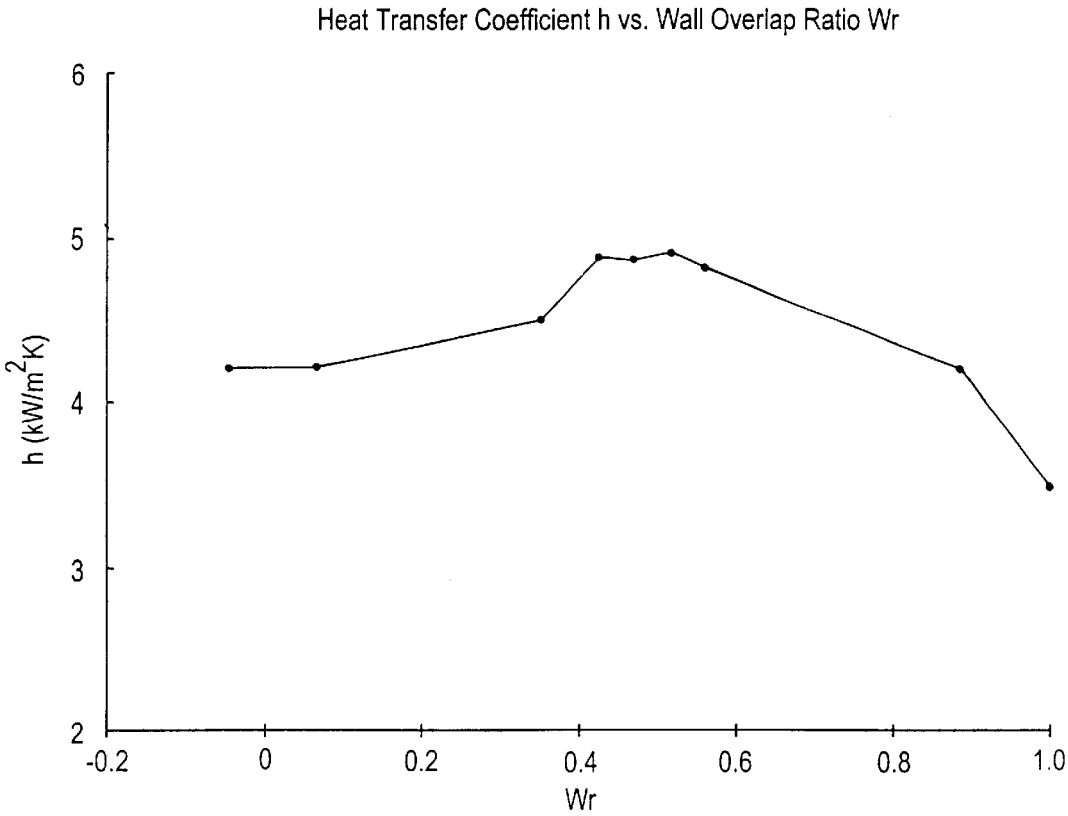

FIG. 10 shows a plot of some of these Wr ratios versus the heat transfer h they provide. These data were generated using an otherwise ordinary aluminum refrigerant tube and fluid, with the hole spacings being manipulated to provide the Wr ratios. Note that the best heat transfer was provided when the Wr ratio was between 0.4 and 0.6; thus, applicants recommend that a wall overlap ratio of Wr=0.5 be provided for optimum heat transfer.

Various other modifications to the present invention may occur to those skilled in the art to which the present invention pertains. For example, although the drawings show only rectangular communication holes 18, it should be apparent that the holes 18 may assume various alternative shapes, including (but not limited to) circular, semi-circular, oval, trapezoidal, hexagonal, etc. Also, while the refrigerant tube is preferably made of aluminum, other materials (e.g., copper, plastic, etc.) may alternatively be used. Furthermore, although the drawings show all communication holes 18 having the same size and shape, it may be desirable in some applications to provide more than one hole size and or shape per tube. Moreover, the communication holes 18 may be provided so as to be generally centered between the upper and lower walls 12/14 (FIG. 4A), or such that they abut or lie generally proximate the upper wall 12 (FIG. 4B) or lower wall (FIG. 4C), or some combination of these. Additionally, although the present invention has been generally characterized as "a refrigerant tube for a heat exchanger", it will be apparent to those skilled in the art that the structure of the present invention may also be used for other purposes, such as for condensing steam or other gases. Other modifications not explicitly mentioned herein are also possible and within the scope of the present invention. It is the following claims, including all equivalents, which define the scope of the present invention.

We claim:

1. A refrigerant tube for a heat exchanger, comprising:

a generally flat tube having generally flat upper and lower walls;

a plurality of reinforcing walls connected between said upper and lower walls, said reinforcing walls extending along and generally parallel with a longitudinal axis of said tube and being spaced apart from one another by a predetermined distance; and each said reinforcing wall having a plurality of communication holes distributed along a length thereof a pitch P in the direction of the longitudinal axis, each said communication hole having a length $L_1$ in the direction of the longitudinal axis, each said reinforcing wall having a plurality of discrete wall portions each extending between adjacent ones of said communication holes wherein a wall overlap ratio Wr is in a range of greater than 0.0 to 0.9 calculated by subtracting twice the communication hole length $L_1$ from the length of the pitch P and dividing the result by the length of the pitch P.

2. The refrigerant tube according to claim 1 wherein the tube is made of aluminum material.

3. The refrigerant tube according to claim 1 wherein the ratio Wr is approximately 0.5.

4. The refrigerant tube according to claim 1 wherein each said communication hole is disposed generally centered between said upper and lower walls.

5. The refrigerant tube according to claim 1 wherein each said communication hole generally abuts said upper wall.

6. The refrigerant tube according to claim 1 wherein each communication hole generally abuts said lower wall.

7. A refrigerant tube for a heat exchanger, comprising:

a generally flat tube having generally flat upper and lower walls;

a plurality of reinforcing walls connected between said upper and lower walls, said reinforcing walls extending along and generally parallel with a longitudinal axis of said tube and being spaced apart from one another by a predetermined distance; and a plurality of communication holes distributed along a length of each said reinforcing wall such that each said reinforcing wall is divided into a plurality of discrete wall portions each extending between adjacent ones of said communication holes, said communication holes and said discrete wall portions having lengths $L_1$ and $L_2$ respectively extending along said longitudinal axis with length $L_2$ being greater than length $L_1$, said communication holes being spaced apart along each said reinforcing wall by a pitch P wherein a wall overlap ratio Wr, defined as $[P-2L_1]/P$ is in a range of $0.4 \leqq Wr \leqq 0.6$.

* * * * *